US011719025B2

(12) United States Patent
Sasaki et al.

(10) Patent No.: US 11,719,025 B2
(45) Date of Patent: Aug. 8, 2023

(54) VEHICLE LATCH DEVICE

(71) Applicant: HONDA MOTOR CO., LTD., Tokyo (JP)

(72) Inventors: Kazutada Sasaki, Wako (JP); Chisato Suetsugu, Wako (JP); Shin Saeki, Wako (JP); Csaba Szente, Newmarket (CA); Ioan Dorin Ilea, Newmarket (CA)

(73) Assignee: HONDA MOTOR CO., LTD., Tokyo (JP)

( * ) Notice: Subject to any disclaimer, the term of this patent is extended or adjusted under 35 U.S.C. 154(b) by 131 days.

(21) Appl. No.: 17/208,144

(22) Filed: Mar. 22, 2021

(65) Prior Publication Data

US 2021/0301563 A1 Sep. 30, 2021

(30) Foreign Application Priority Data

Mar. 26, 2020 (JP) ..... JP2020-056914

(51) Int. Cl.
*E05B 83/24* (2014.01)
*E05B 77/08* (2014.01)

(52) U.S. Cl.
CPC ..... *E05B 83/24* (2013.01); *E05B 77/08* (2013.01)

(58) Field of Classification Search
CPC ..... E05B 77/08; E05B 77/02; E05B 83/24; E05B 83/243; E05B 83/16; E05B 81/10; B60R 21/38; B60R 2021/0004
See application file for complete search history.

(56) References Cited

U.S. PATENT DOCUMENTS

| | | | | |
|---|---|---|---|---|
| 8,584,787 | B2 * | 11/2013 | Hwang | B60R 21/38 180/274 |
| 10,717,407 | B2 * | 7/2020 | Szente | E05B 77/08 |
| 11,060,327 | B2 * | 7/2021 | Szente | E05B 83/24 |
| 11,066,854 | B2 * | 7/2021 | Szente | E05B 77/08 |
| 11,318,909 | B2 * | 5/2022 | Szente | E05B 77/08 |
| 2012/0074715 | A1 | 3/2012 | Kim | |
| 2013/0033069 | A1 | 2/2013 | Hwang | |
| 2014/0159386 | A1 | 6/2014 | Faruque et al. | |
| 2016/0130842 | A1 | 5/2016 | Ferri et al. | |

(Continued)

FOREIGN PATENT DOCUMENTS

| | | |
|---|---|---|
| CN | 102416983 A | 4/2012 |
| CN | 103863240 A | 6/2014 |

(Continued)

OTHER PUBLICATIONS

Office Action received in corresponding CN application No. 202110295140.6 dated Feb. 16, 2022 with English translation (13 pages).

*Primary Examiner* — Alyson M Merlino
(74) *Attorney, Agent, or Firm* — Rankin, Hill & Clark LLP

(57) ABSTRACT

Provided is a vehicle latch device including a latch body capable of being lifted up in a state of latching a striker provided to a hood of a vehicle; a position holder that holds a position of the latch body on a vehicle body side during a normal time; and an actuator that is interposed between the latch body and the position holder and lifts up the latch body at a time of pop-up. On the position holder, a striker releaser is disposed which releases a latched state of the striker latched by a latch of a latch mechanism provided to the latch body.

1 Claim, 11 Drawing Sheets

(56) References Cited

U.S. PATENT DOCUMENTS

| | | | | |
|---|---|---|---|---|
| 2019/0152425 | A1 | 5/2019 | Szente et al. | |
| 2019/0152426 | A1 | 5/2019 | Szente et al. | |
| 2019/0338567 | A1* | 11/2019 | Szente | E05B 77/08 |
| 2020/0240181 | A1 | 7/2020 | Ferri et al. | |

FOREIGN PATENT DOCUMENTS

| | | | | | |
|---|---|---|---|---|---|
| CN | 105228883 | A | | 1/2016 | |
| CN | 109881999 | A | | 6/2019 | |
| DE | 19957868 | A1 | * | 6/2001 | E05B 77/08 |
| DE | 102004046162 | A1 | * | 4/2005 | B60R 21/38 |
| DE | 102004015819 | A1 | * | 11/2005 | E05B 77/08 |
| DE | 102005006688 | A1 | * | 8/2006 | E05B 77/08 |
| DE | 102005060750 | A1 | * | 6/2007 | E05B 77/08 |
| EP | 1528201 | A1 | * | 5/2005 | E05B 77/08 |
| EP | 1528201 | A1 | | 5/2005 | |
| EP | 1541432 | A1 | * | 6/2005 | E05B 77/08 |
| EP | 1541432 | A1 | | 6/2005 | |
| EP | 2096007 | A1 | * | 9/2009 | E05B 77/08 |
| JP | 2015-009578 | A | | 1/2015 | |

* cited by examiner

VEHICLE LATCH DEVICE

BACKGROUND OF THE INVENTION

1. Field of the Invention

The present invention relates to a vehicle latch device for lifting up the hood of a vehicle when the vehicle collides with a protection target such as a pedestrian in order to receive the protection target so as to relax the impact.

2. Description of the Related Art

Heretofore, vehicle latch devices disclosed, for example, in Patent Literature 1 has been known as pop-up devices that, at the time of a collision between a vehicle and a protection target (pedestrian), cause the hood of the vehicle to lift and receive the protection target to thereby reduce the impact.

In the vehicle latch device in Patent Literature 1, a hood locking device (22) is pivotally attached to a hood locking device support portion (24), and a latch (50) to which an operation cable (52) is coupled is pivotally mounted to the hood locking device (22). The structure is such that the latch (50) and the operation cable (52) pivot along with the hood locking device (22).

PRIOR ART DOCUMENT(S)

Patent Literature(s)

Patent Literature 1: JP 2015-009578 A

SUMMARY OF THE INVENTION

In the vehicle latch device in Patent Literature 1, the operation cable (52) is attached to the latch (50) side, which pivots along with the hood locking device (22), and pivots along with them about a support pin (66). Thus, the movement is wasteful.

In view of the above, an object of the present invention is to provide a vehicle latch device capable of more smoothly moving a latch body.

In order to solve the above-described problem, the present invention provides a vehicle latch device including: a latch body capable of being lifted up in a state of latching a striker provided to a hood of a vehicle; a position holder that holds a position of the latch body on a vehicle body side during a normal time; and an actuator that is interposed between the latch body and the position holder and lifts up the latch body at a time of pop-up, in which on the position holder, a striker releaser is disposed which releases a latched state of the striker latched by a latch of a latch mechanism provided to the latch body.

The present invention can provide a vehicle latch device capable of more smoothly moving a latch body.

DETAILED DESCRIPTION OF THE EMBODIMENTS

An example of a vehicle latch device 1 according to an embodiment of the present invention will be described below with reference to FIGS. 1 to 11B. Note that the description will be provided as appropriate with "front", "rear", "upper", "lower", and "left" and "right" representing a forward direction of, a rearward direction of, a vertically upward direction from, a vertically downward direction from, and width directions of the vehicle, respectively.

<<Vehicle>>

Figure 1:
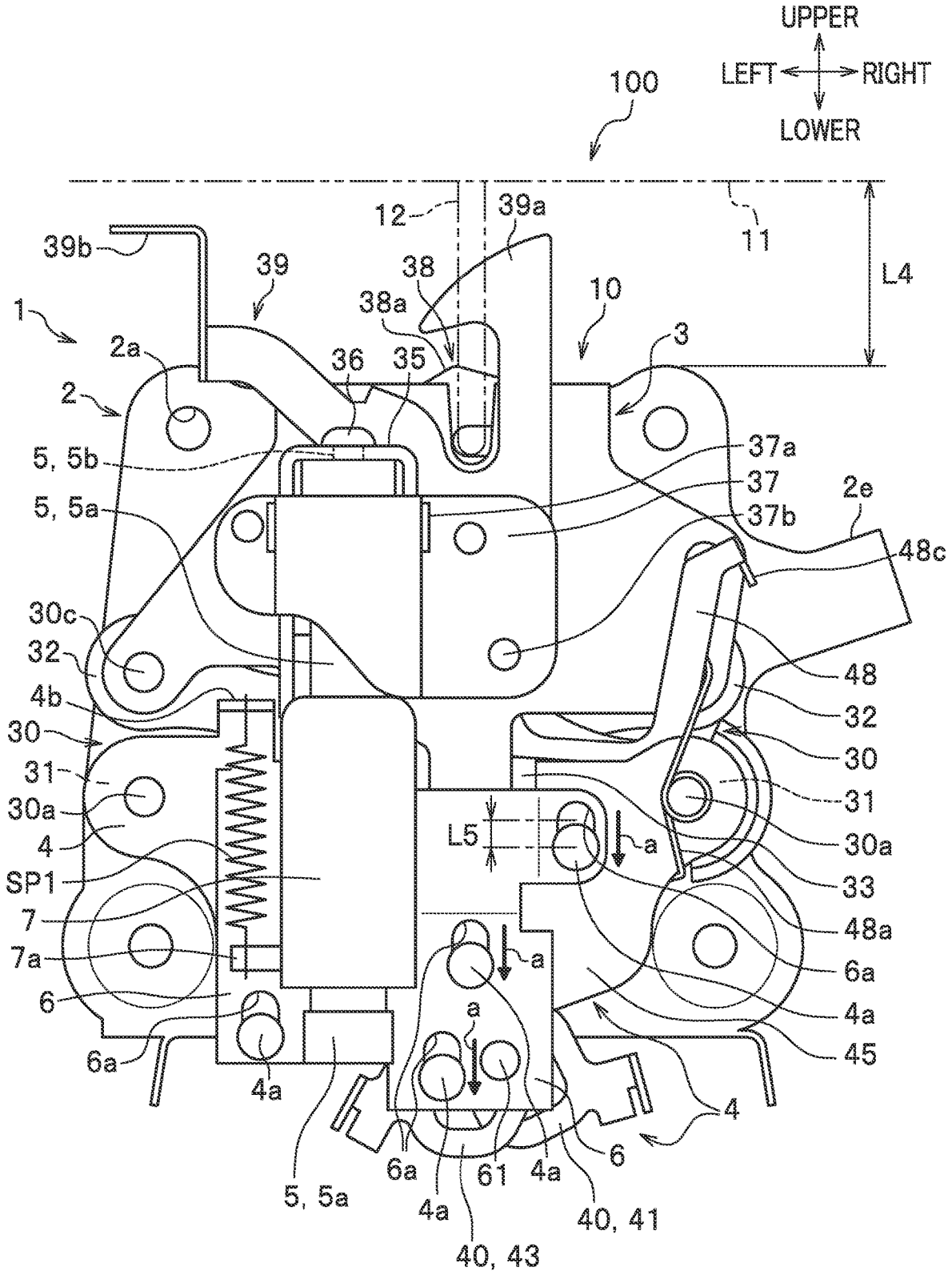
FIG. 1 is a schematic front view of a main part of a vehicle latch device according to an embodiment of the present invention illustrating the state of the vehicle latch device during a normal time.

As illustrated in FIG. 1, a vehicle in which the vehicle latch device 1 of the present invention is used may only need to be a hood-type automobile including a hood 11 on the front side of the vehicle body. The vehicle may be a passenger vehicle, a maintenance vehicle, or a bus, and the vehicle type is not particularly limited. The following description will be provided by taking a passenger vehicle having an engine compartment in a front part of its vehicle body as one example of the vehicle.

The vehicle includes a pop-up apparatus 100 that lifts up the hood 11 to protect a protection target colliding with the vehicle.

The hood 11 is an engine hood panel capable of elastically receiving a protection target such as a pedestrian (hereinafter referred to as "pedestrian" as appropriate) when the pedestrian collides with the vehicle to relax the impact. The hood 11 includes a hood skin installed on the upper side of the engine compartment, a hood frame elastoplastically joined to the lower surface of the hood skin, and a striker 12 fixed to the lower surface of a front portion of the hood 11.

<<Pop-Up Apparatus>>

The pop-up apparatus 100 has a function of receiving a pedestrian on the hood 11 lifted up when the pedestrian collides with the vehicle, and a function of preventing the hood 11 having received the pedestrian from contacting a power unit (not illustrated).

The pop-up apparatus 100 includes the vehicle latch device 1 disposed under each of the front left and right sides of the hood 11, a vehicle hinge device (not illustrated)

disposed under each of the rear left and right sides of the hood 11, and a collision detection device (not illustrated).

<Collision Detection Device>

The collision detection device (not illustrated) is a device that detects a collision of a pedestrian with the front part of the vehicle. The collision detection device (not illustrated) is installed at the front end of the vehicle.

<Vehicle Latch Device>

Figure 3:
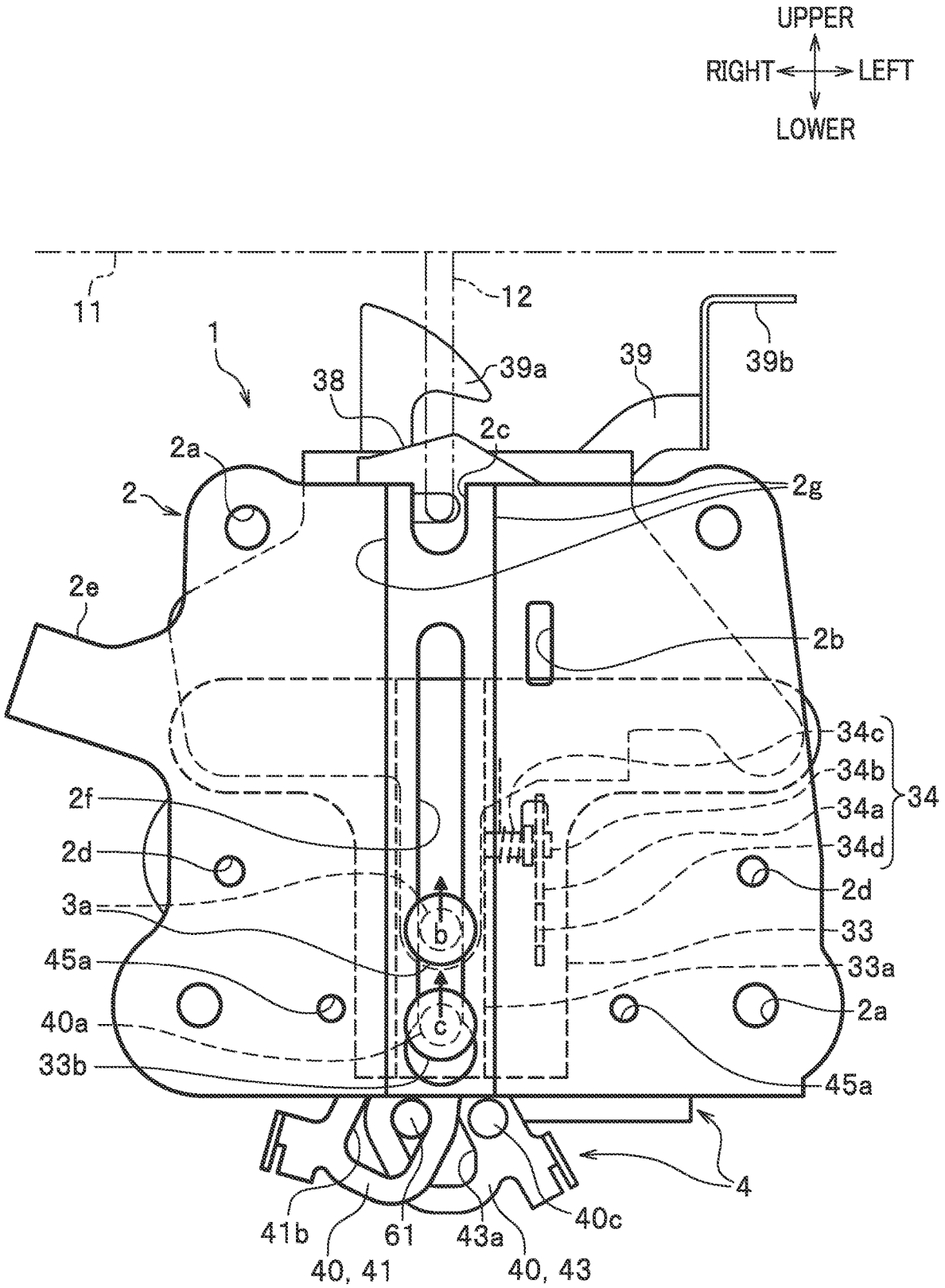
FIG. 3 is a schematic back view of the main part of the vehicle latch device illustrating the state of the vehicle latch device during a normal time.

As illustrated in FIG. 3, the vehicle latch device 1 is a device that lifts up the hood 11 by means of an actuator 5 with the striker 12 locked by a latch 38*a* of a latch mechanism 38, when the collision detection device (not illustrated) detects a collision of a pedestrian with the vehicle. The vehicle latch device 1 includes a latch body 3, a position holder 4, the actuator 5, and a hood locking mechanism 10. The vehicle latch device 1 is a hood moving device that lifts up the latch body 3 and the hood 11 by causing a piston rod portion 5*b* to project upward with a high-pressure gas generated by high-speed combustion of a gas generating agent inside the actuator 5. By lifting up the whole hood 11 along with each vehicle hinge device (not illustrated) in this manner, the vehicle latch device 1 functions to improve the impact absorption performance in the collision of the pedestrian with the hood 11.

<Base Plate>

A base plate 2 illustrated in FIG. 1 is a metallic plate member to be attached to the vehicle body for fixing the vehicle latch device 1 to the vehicle body. As illustrated in FIG. 3, the base plate 2 is a substantially square member having vehicle body fixing holes 2*a*, a latching hole 2*b*, a striker engagement groove 2*c*, first link pivotal support holes 2*d*, a wire fixing portion 2*e*, a guide portion 2*f*, and a rail portion 2*g*. The base plate 2 is fixed to a front part of the vehicle body such as an upper portion of the bulk head by bolts (not illustrated) inserted in the four vehicle body fixing holes 2*a* formed in upper left and right portions and lower left and right portions of the base plate 2.

The latching hole 2*b* is a hole with which a locking member 34 provided to the latch body 3 engages when the latch body 3 is lifted up by the actuator 5 to thereby hold the latch body 3 in the lifted state. The latching hole 2*b* is an elongated hole longer in the vertical direction along the guide portion 2*f* of the base plate 2.

As illustrated in FIG. 3, the striker engagement groove 2*c* is a groove into which a lower end portion of the striker 12 is inserted when the hood 11 is lowered. The striker engagement groove 2*c* is formed in the center of an upper end portion of the base plate 2. FIG. 1 illustrates a distance L4 between the base plate 2 and the hood 11 when the hood 11 is lowered.

As illustrated in FIG. 1 or 3, the first link pivotal support holes 2*d* are holes in which coupling pins 30*a* are attached in order to support later-described left and right first links 31, the position holder 4, and an open lever biasing spring 48*a*. As illustrated in FIG. 3, the first link pivotal support holes 2*d* are formed respectively in left and right end portions of the base plate 2 at positions somewhat off to its lower end portion.

The wire fixing portion 2*e* is a portion to which to fix a portion of a cable (not illustrated) pulled out of the vehicle latch device 1, the cable being hooked at one end on the striker releaser 48. The wire fixing portion 2*e* is a protruding piece protruding from the base plate 2 toward the left side.

The guide portion 2*f* is a hole in which an engagement portion 3*a* of the latch body 3 and a slide pin 33*b* of the position holder 4 are inserted vertically slidably to restrict movement of the latch body 3 and the position holder 4 to vertical movement. The guide portion 2*f* is an elongated hole provided to extend in the vertical direction in a center portion of the rail portion 2*g* formed at a center portion of the base plate 2 in a hat shape in a horizontal cross-sectional view.

The rail portion 2*g* is a guide portion formed in the hat shape in a horizontal cross-sectional view. The rail portion 2*g* is provided to extend in the vertical direction at the center portion of the base plate 2. A slide portion 33*a* formed on a slide member 33 in a hat shape in a horizontal cross-sectional view is engaged vertically movably with this rail portion 2*g*.

<Latch Body>

Figure 8:
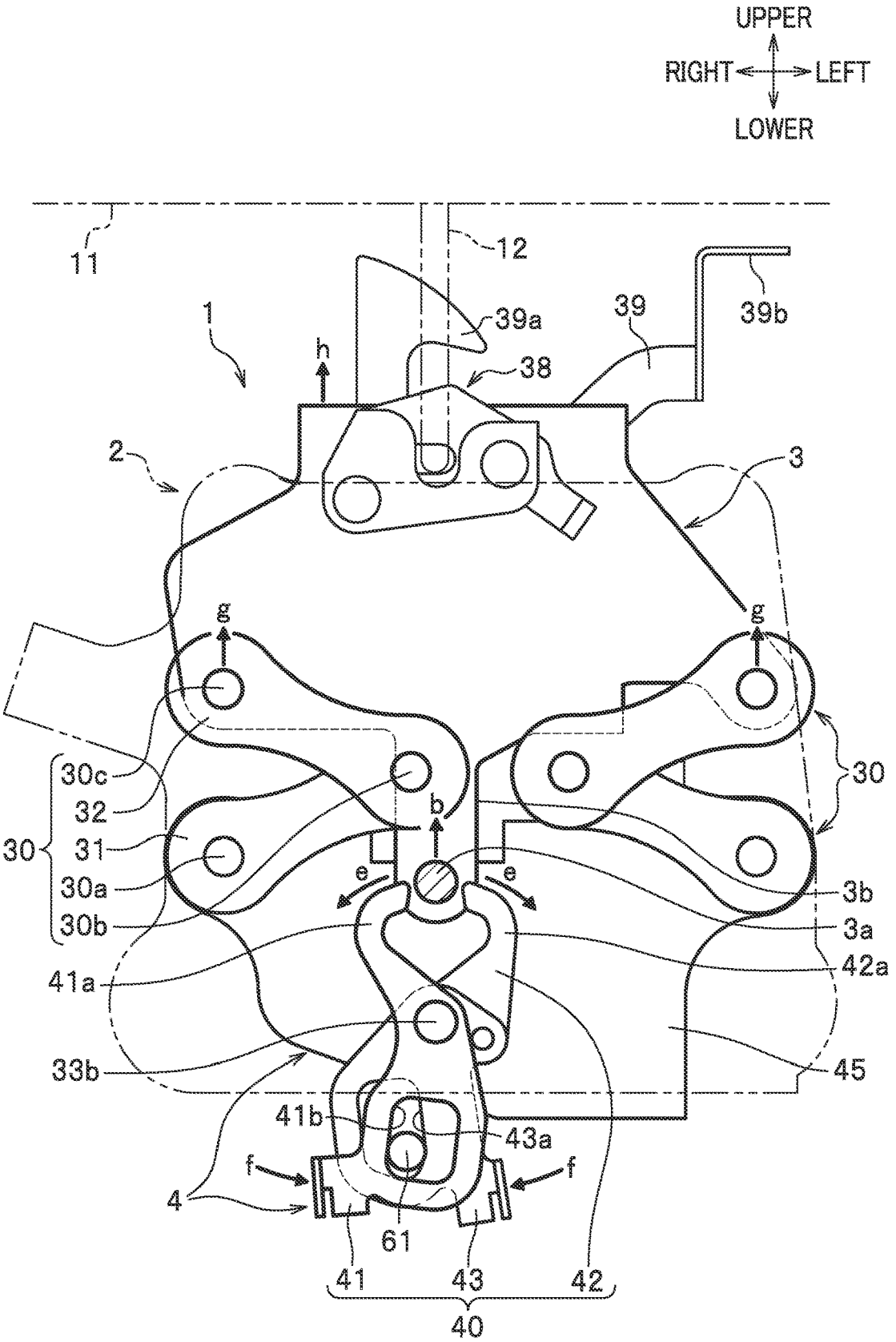
FIG. 8 is an explanatory view illustrating the state of the vehicle latch device when an actuator has lifted up a latch body.
Figure 9:
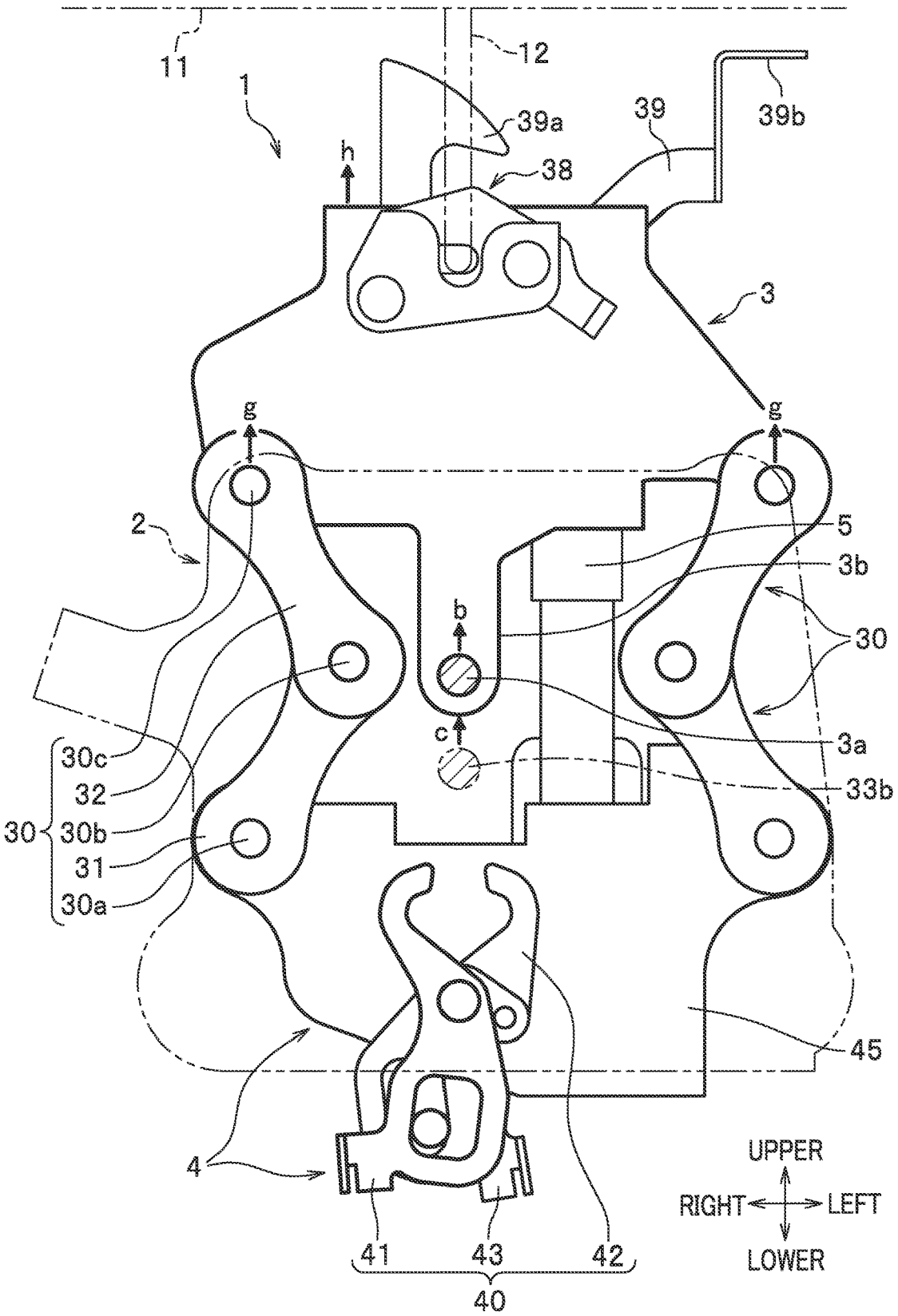
FIG. 9 is an explanatory view illustrating the state of the vehicle latch device when the actuator has further lifted up the latch body.
Figure 10:
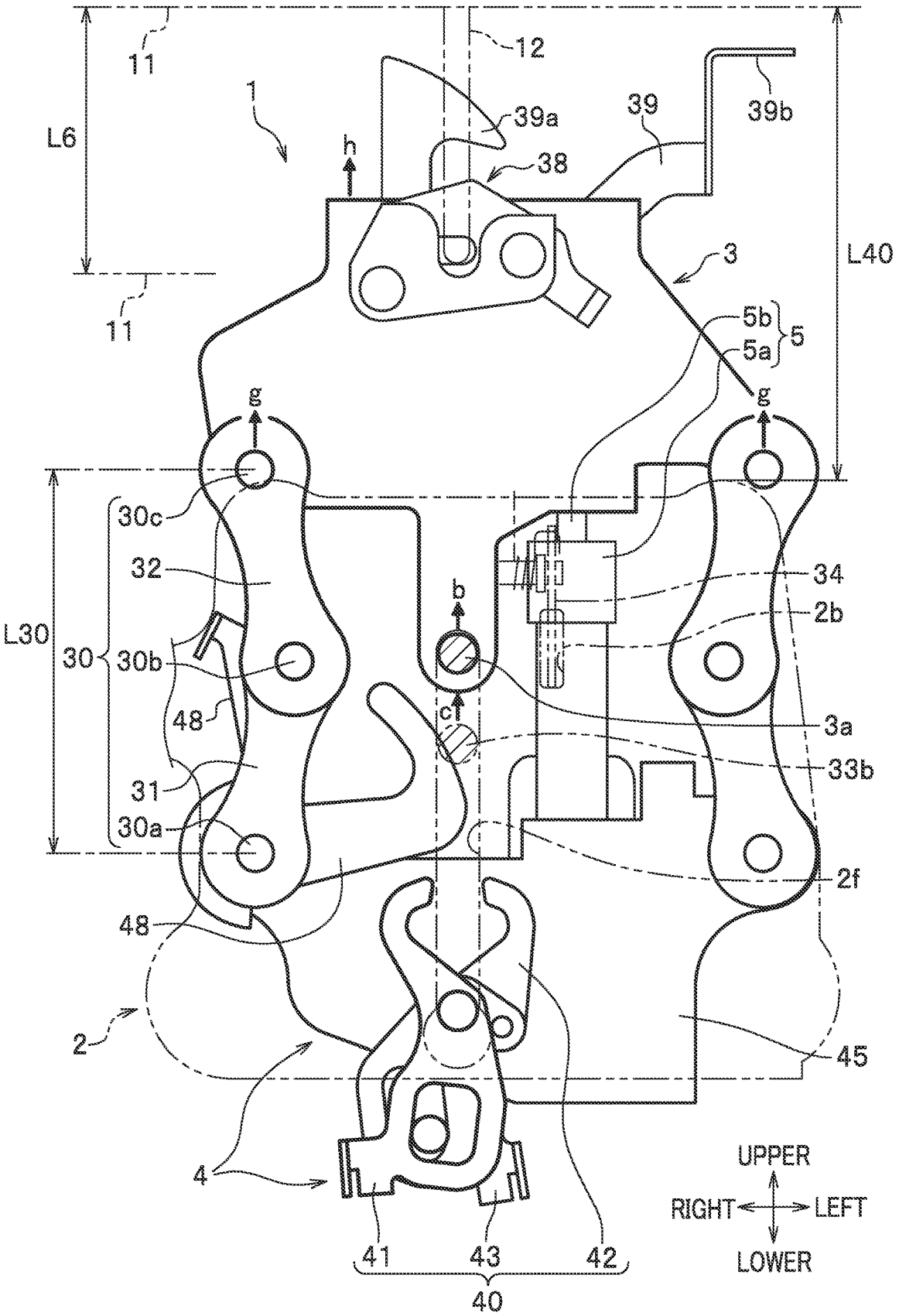
FIG. 10 is an explanatory view illustrating the state of the vehicle latch device having completed the pop-up.

As illustrated in FIGS. 8 to 10, the latch body 3 is a latching plate member capable of being lifted up in a state of latching the striker 12 provided to the hood 11 of the vehicle at a time of pop-up. The latch body 3 and the position holder 4 are coupled by a pair of link mechanisms 30 disposed opposite each other at left and right end portions of the vehicle latch device 1. As illustrated in FIG. 1, the latch body 3 has the engagement portion 3*a* (see FIG. 10), the first links 31, the slide member 33, the locking member 34 (see FIG. 3), a rod support member 35, a rod tip portion 36, a rod support member coupling plate 37, the latch mechanism 38, and a striker latching member 39.

<Engagement Portion>

Figure 4:
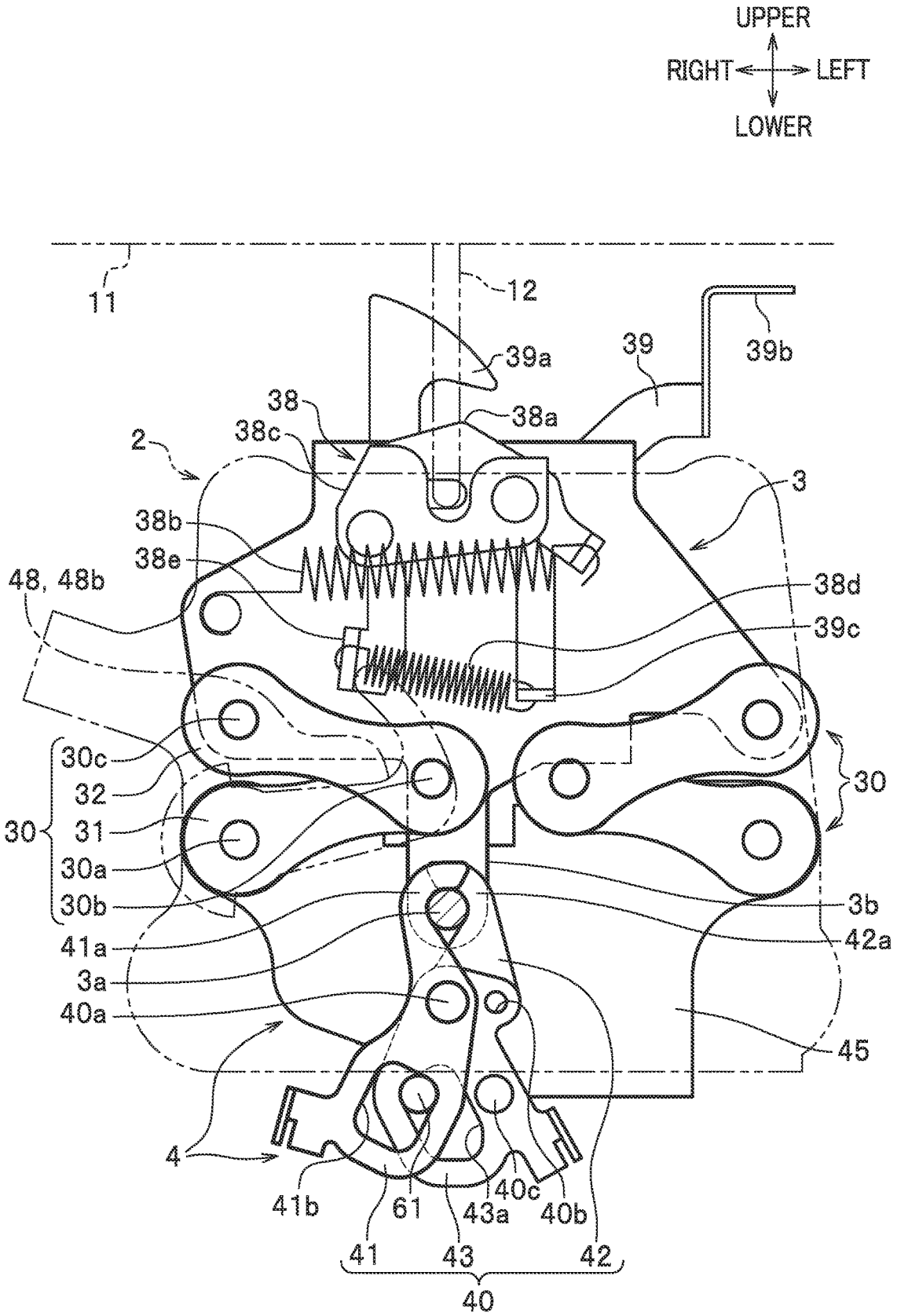
FIG. 4 is an explanatory view illustrating the state of the vehicle latch device before pop-up.
Figure 5:
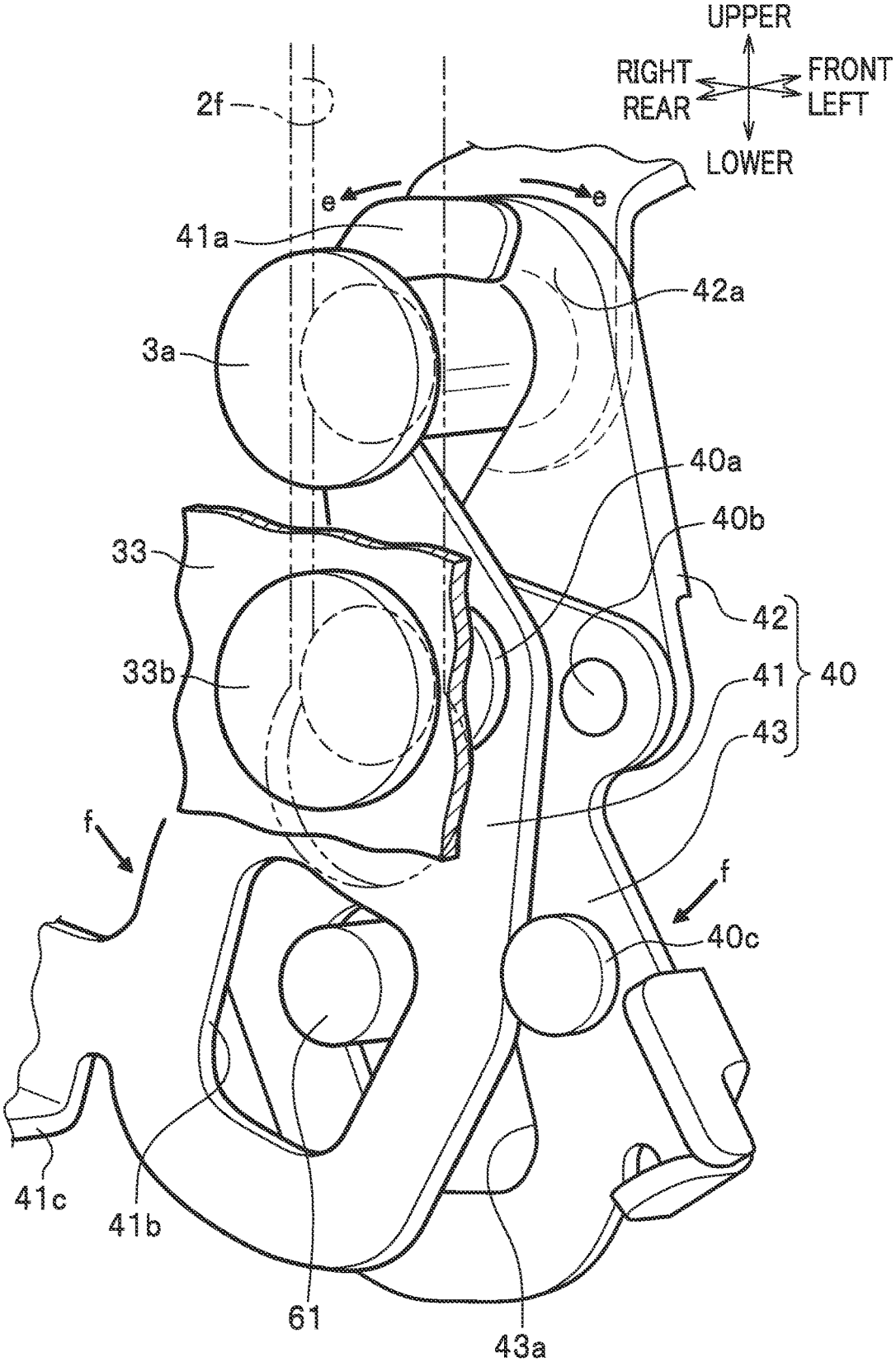
FIG. 5 is an enlarged perspective view of the main part illustrating the state of a latching portion before pop-up.

The engagement portion 3*a* is a pin movably engaged with the guide portion 2*f* provided to extend in the direction of movement of the latch body 3 (vertical direction), as illustrated in FIG. 3, and latched by a later-described latching portion 40 in a state before pop-up, as illustrated in FIGS. 4 and 5. The engagement portion 3*a* is attached to the center of a lower end portion of the latch body 3 (see FIGS. 9 and 10). As illustrated in FIG. 4, the engagement portion 3*a* holds the latch body 3 in a lowered state by being latched by hooks 41*a* and 42*a*.

<Link Mechanisms>

As illustrated in FIGS. 4 and 10, the link mechanisms 30 are coupling mechanisms that couple the latch body 3 to the position holder 4 in such a state that the latch body 3 can be lifted and lowered while maintaining a horizontal posture. The link mechanisms 30 are a six-jointed link mechanism with the first links 31, second links 32, and the coupling pins 30*a* and coupling pins 30*b* and 30*c* disposed bilaterally symmetrically. The link mechanisms 30 couple left and right end portions of the latch body 3 and left and right end portions of the position holder 4 to each other.

Lower end portions of the first links 31 are pivotally coupled to left and right upper end portions of the position holder 4 by the coupling pins 30*a*. Upper end portions of the first links 31 and lower end portions of the second links 32 are pivotally coupled by the coupling pins 30*b*. Upper end portions of the second links 32 are pivotally coupled to the left and right end portions of the latch body 3 by the coupling pins 30*c*.

Figure 2:
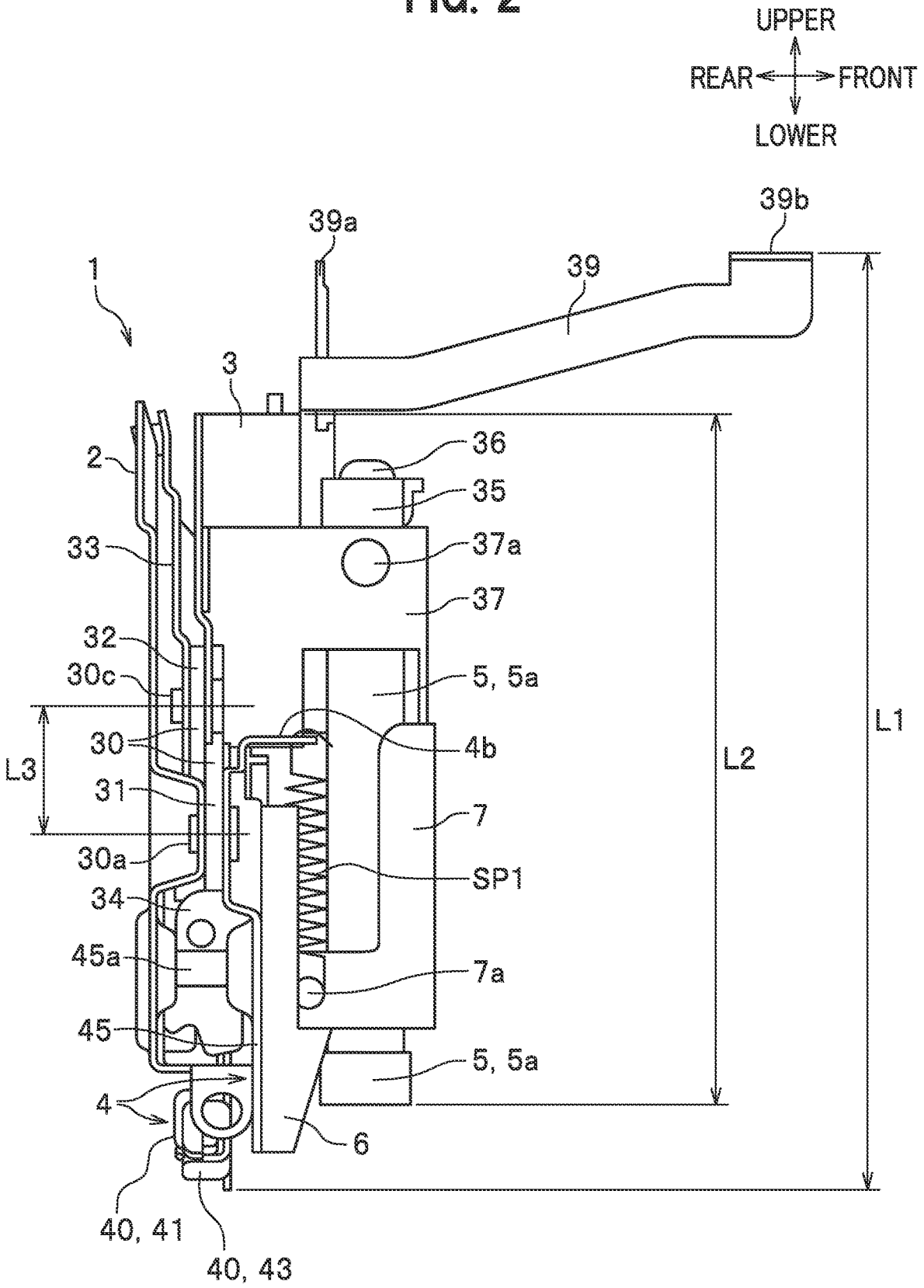
FIG. 2 is a schematic side view of the main part of the vehicle latch device illustrating the state of the vehicle latch device during a normal time.

As illustrated in FIG. 2, the slide member 33 is a metallic plate member that is coupled to the latch body 3 by the coupling pins 30*c* via the second links 32, and moves vertically along with the latch body 3. As illustrated in FIG. 3, the slide member 33 has the slide portion 33*a* provided to extend downward from a center portion of the slide member 33, and the slide pin 33*b* (see FIG. 5) provided on a lower end portion of the slide portion 33*a*.

As illustrated in FIGS. 3 and 5, the slide portion 33*a* is fitted vertically movably in the rail portion 2*g* of the base plate 2.

The slide pin 33*b* is inserted vertically movably in the guide portion 2*f*, which is provided to extend in the vertical direction, at a preset distance downward from the engagement portion 3*a*.

<Locking Member>

Figure 11B:
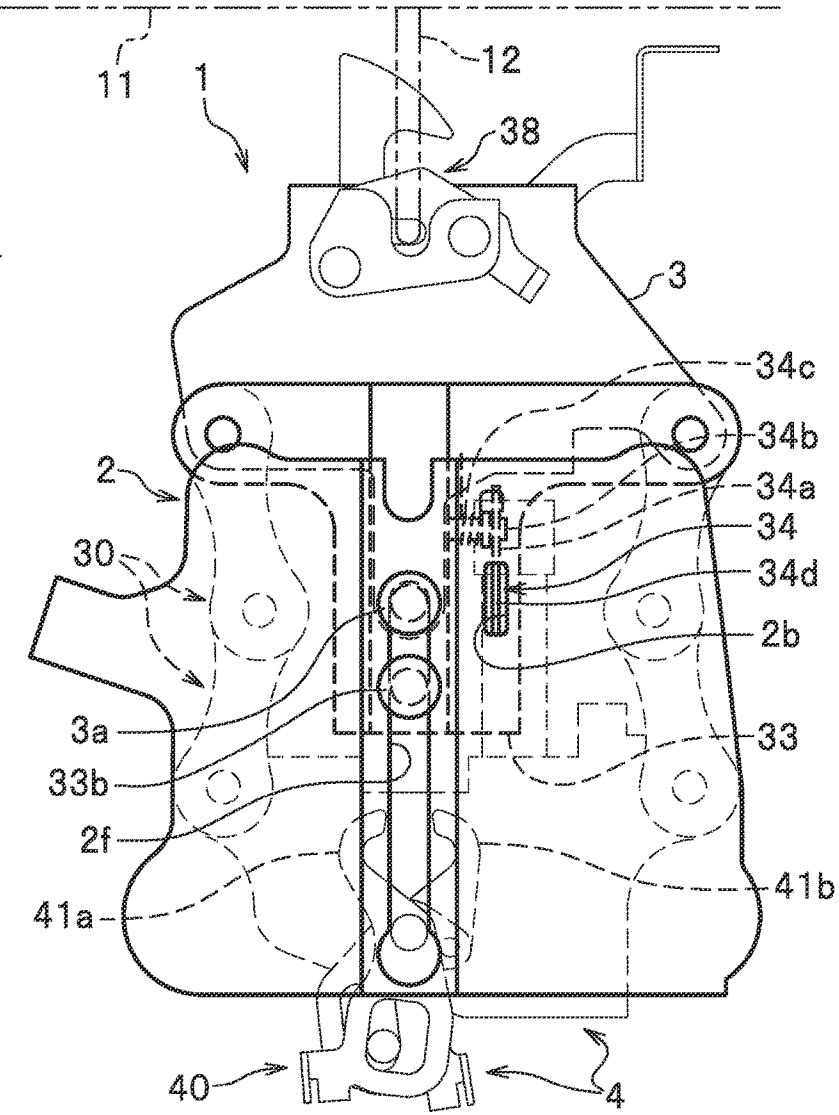
FIG. 11B is a schematic view illustrating the state of the vehicle latch device having completed pop-up.

As illustrated in FIG. 3, the locking member 34 is a member whose locking portion 34*d* engages with the latching hole 2*b* in the base plate 2 when the latch body 3 is lifted up by the actuator 5 from the lowered state in a normal time to thereby maintain the latch body 3 in the lifted state (see FIGS. 10 and 11B). The locking member 34 includes a locking member body 34*a* made of a metallic plate and having the locking portion 34*d*, a locking member support shaft 34*b* supporting the locking member body 34*a* pivotally on the slide member 33, and a locking member biasing spring 34*c* biasing the locking member body 34*a* toward the base plate 2.

As illustrated in FIG. 1, the rod support member 35 is a metallic plate member with an inverted U-shape fixed to the tip surface of the piston rod portion 5*b* of the actuator 5 by the rod tip portion 36.

As illustrated in FIGS. 1 and 2, the rod tip portion 36 is a fixing member such as a screw screwed to the tip surface of the piston rod portion 5*b* and inserted into the rod support member 35 from below from the piston rod portion 5*b*.

As illustrated in FIG. 1 or 2, the rod support member coupling plate 37 is a metallic plate member that couples the rod support member 35 to the latch body 3. The rod support member coupling plate 37 is disposed so as to cover an upper portion of the actuator 5. The rod support member coupling plate 37 is provided with fixing pins 37*a* that fix the rod support member 35 to the rod support member coupling plate 37, and fixing pins 37*b* that fix the rod support member coupling plate 37 to the latch body 3.

<Hood Locking Mechanism>

As illustrated in FIG. 1, the hood locking mechanism 10 is a device that maintains the hood 11, which can be opened and closed relative to the vehicle body, in a closed state. The hood locking mechanism 10 includes the striker 12 provided to the hood 11, and the latch mechanism 38 and the striker latching member 39 provided to the vehicle body. The hood locking mechanism 10 maintains the hood 11 in the closed state by engaging the striker 12 with the latch 38*a* of the latch mechanism 38.

As illustrated in FIG. 4, the latch mechanism 38 is a device having a function of holding the striker 12 in a locked state by latching the striker 12 to the latch 38*a*. The latch mechanism 38 is formed by mounting the latch 38*a*, a latch spring 38*b*, a plate 38*c*, a release spring 38*d*, a latch release portion 38*e*, and so on to the base plate 2, in which the striker engagement groove 2*c* (see FIG. 3) for inserting the striker 12 is formed.

The latch 38*a* is a holding member that holds the striker 12 in a lowered position to maintain the hood 11 in a state of closing an opening portion of the engine compartment. The latch 38*a* is pivotally supported on the latch body 3. In response to an opening operation of a hood open lever (not illustrated) disposed around the driver's seat, the latch 38*a* is disengaged from the latch release portion 38*e*, so that the striker 12 is released by the bias of the latch spring 38*b* from the locking position of the latch 38*a* and is lifted up.

The latch spring 38*b* is a spring member that biases the latch 38*a* in an unlatching direction. The latch spring 38*b* is a compression coil spring, for example. The latch spring 38*b* is hooked at one end on the latch 38*a* and looked at the other end on the latch body 3.

The plate 38*c* is a member that latches the latch 38*a* in the locking position.

The release spring 38*d* is a spring member that biases the plate 38*c* and the striker latching member 39 in a latching direction. The release spring 38*d* is a compression coil spring, for example. The release spring 38*d* is hooked at one end on the latch release portion 38*e* and hooked at the other end on a spring hooking portion 39*c* of the striker latching member 39.

The striker latching member 39 includes a striker hook portion 39*a*, a striker release lever portion 39*b*, and the spring hooking portion 39*c*.

The striker hook portion 39*a* is a hook which latches the striker 12 released and lifted up from the locking position of the latch 38*a* as a result of the opening operation of the hood open lever (not illustrated) around the driver's seat. The striker release lever portion 39*b* is an operation portion which, by being operated, releases the striker 12 latched by the striker hook portion 39*a* to thereby open the hood 11.

The spring hooking portion 39*c* is a portion on which one end of the above-described release spring 38*d* is hooked.

<Position Holder>

As illustrated in FIG. 1, the position holder 4 is a position holding device that holds the position of the latch body 3 on the vehicle body side during a normal time. The position holder 4 includes the link mechanisms 30, the latching portion 40, engagement portions 4*a*, an actuator bracket 45, the striker releaser 48, the actuator 5, a slider 6, an actuator holding portion 7, and a spring member SP1. The position holder 4 is disposed at a front lower end portion of the latch body 3.

<Latching Portion>

As illustrated in FIG. 4, the latching portion 40 is a member that holds the latch body 3 in the lowered state by clutching the engagement portion 3*a*, which is a part of the latch body 3. The latching portion 40 includes a set of members including a first latching portion 41, a second latching portion 42, and a third latching portion 43.

As illustrated in FIG. 4 or 5, the first to third latching portions 41 to 43 are plate-shaped members pivotally supported on the actuator bracket 45 by a pivot pin 40*a*. The second and third latching portions 42 and 43 are coupled to each other by a fixing pin 40*b* such that they cannot pivot relative to each other. The first latching portion 41 and the second and third latching portions 42 and 43 are supported by a latching portion restriction member 40*c* in such a state that, during a normal time, the hooks 41*a* and 42*a* pivot about the pivot pin 40*a* in the manner of a pair of scissors and pinch (clutch) the engagement portion 3*a* of the latch body 3 from a plurality of directions (from the left and right sides).

The first latching portion 41 is a member formed in a substantially S-shape in a back view. The first latching portion 41 has the hook 41*a* formed on the upper side, a loose pin insertion hole 41*b* formed on the lower side, and a pivot pin installation hole (not illustrated) formed in a center portion.

The hook 41*a* is a portion that engages with the engagement portion 3*a* of the latch body 3 from the right side. The hook 41*a* extends upward in an inverted J-shape from the center portion of the first latching portion 41.

The loose pin insertion hole 41*b* is a hole in which a latching portion actuation pin 61 provided on the slider 6 is inserted vertically movably. The loose pin insertion hole 41*b* is a hole larger in the vertical and lateral directions than the outer diameter of the latching portion actuation pin 61, which is cylindrical, so that the first latching portion 41 can pivot about the pivot pin 40*a*. The loose pin insertion hole 41*b* is disposed so as to extend obliquely downward toward the right side during a normal time. Specifically, the loose pin insertion hole 41*b* is tilted such that the loose pin insertion hole 41*b* contacts the latching portion actuation pin 61 from the left side and the farther the loose pin insertion hole 41*b* extends downward, the farther it is located toward the right side.

As illustrated in FIG. 4, the second latching portion 42 has the hook 42*a* with a shape symmetrical to the shape of the hook 41*a*. The hooks 41*a* and 42*a* pinch the engagement portion 3*a* to hold the latch body 3 in the lowered state. The hooks 41*a* and 42*a* are disposed so as to overlap at their tip portions and clutch the engagement portion 3*a* while pinching the engagement portion 3*a*. By releasing the engagement portion 3*a*, the hooks 41*a* and 42*a* bring the latch body 3 into a state where it can be lifted up.

The third latching portion 43 has a loose pin insertion hole 43*a* in which the latching portion actuation pin 61 is inserted vertically movably, and the latching portion restriction member 40*c*, which restricts pivotal movement of the latching portion 40.

The loose pin insertion hole 43*a* is a hole larger in the vertical and lateral directions than the outer diameter of the latching portion actuation pin 61 so that the third latching portion 43 can pivot about the pivot pin 40*a*. The loose pin insertion hole 43*a* is disposed so as to extend obliquely downward toward the left side during a normal time. Specifically, the loose pin insertion hole 43*a* is tilted such that the loose pin insertion hole 43*a* contacts the latching portion actuation pin 61 from the right side and the farther the loose pin insertion hole 43*a* extends downward, the farther it is located toward the left side.

Figure 6:
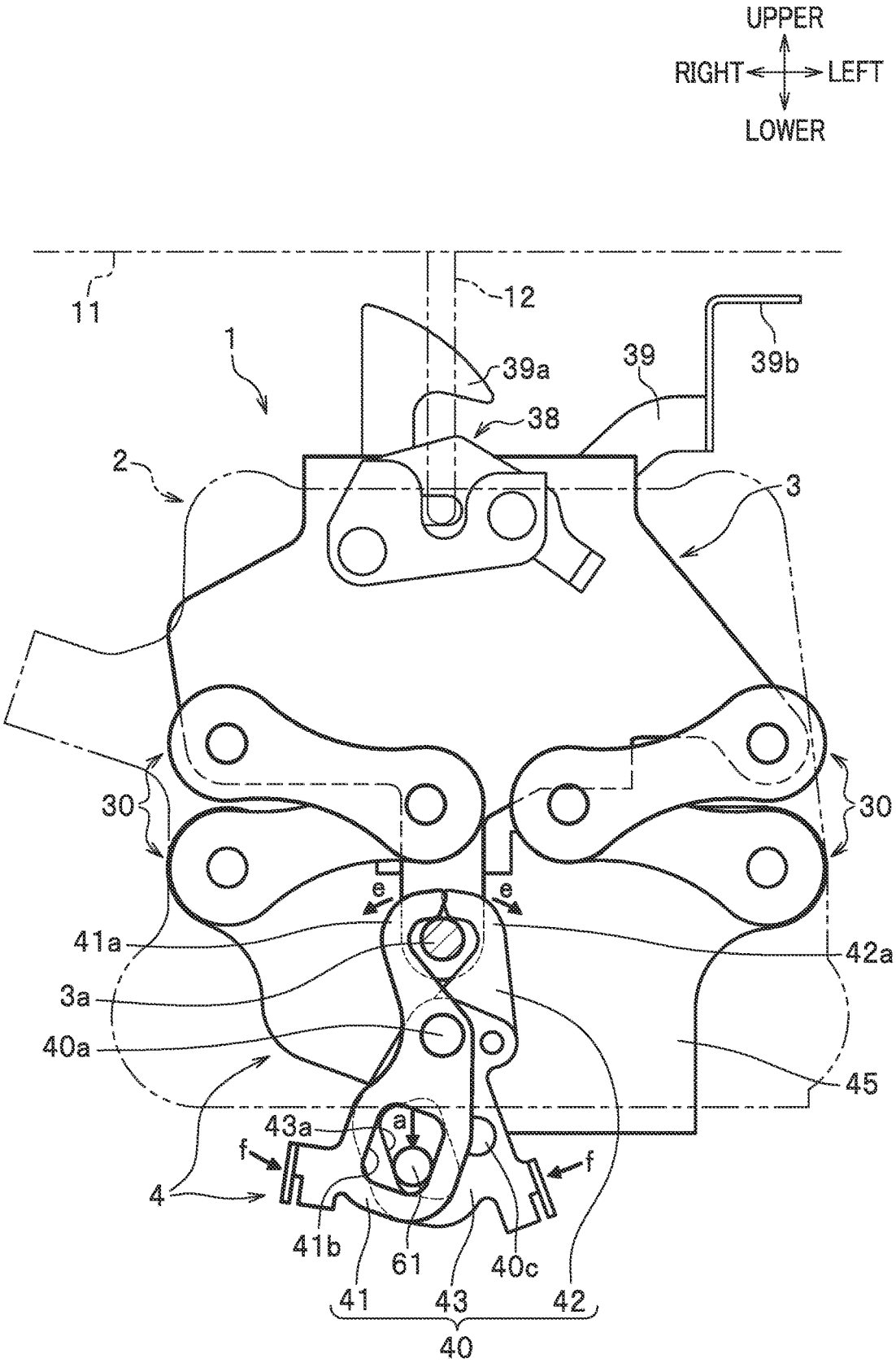
FIG. 6 is an explanatory view illustrating the state of the vehicle latch device releasing the state of being fixed by the latching portion.
Figure 7:
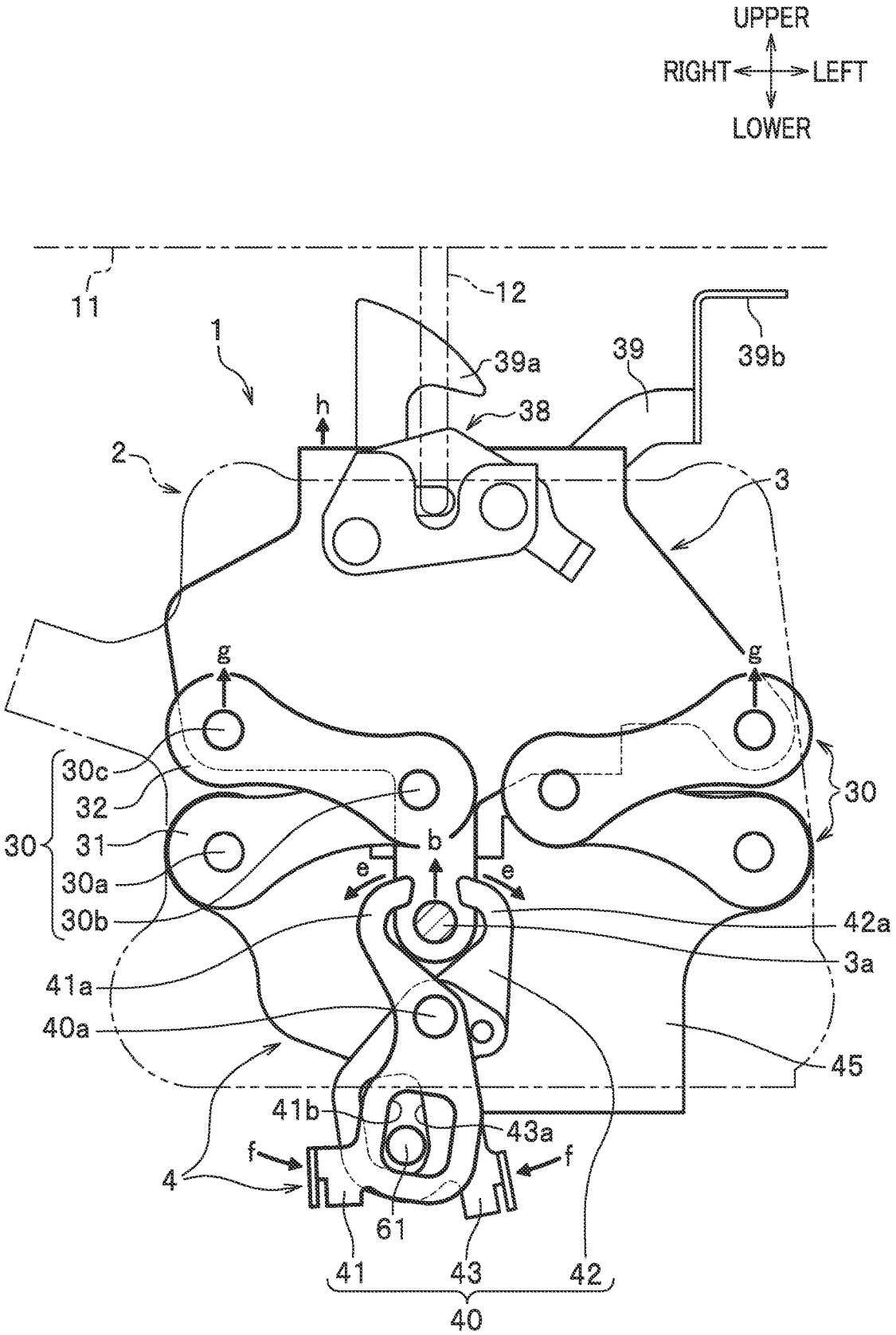
FIG. 7 is an explanatory view illustrating the state of the vehicle latch device having started pop-up.

As illustrated in FIG. 5, the latching portion restriction member 40*c* is a stopper with a protruding shape that contacts the first latching portion 41 to restrict pivotal movement of the first latching portion 41 in the direction of separating the hooks 41*a* and 42*a* from each other. As illustrated in FIGS. 6 and 7, at the time of a collision, the latching portion restriction member 40*c* gets broken and removed by the first latching portion 41 pushed and pivoted by the latching portion actuation pin 61 as a result of actuation of the actuator 5 (see FIG. 1), thereby enabling the pivotal movement in the direction of separating the hooks 41*a* and 42*a* from each other.

<Engagement Portion of Position Holder>

As illustrated in FIG. 1, the engagement portions 4*a* are position holder attachment pins that are engaged vertically movably with a plurality of guide portions 6*a* formed in the slider 6. The engagement portions 4*a* are inserted in the guide portions 6*a*, which are elongated holes being longer in the vertical direction of the slider 6 and provided at a plurality of positions on upper, lower, left, and right portions of the actuator bracket 45 of the position holder 4. This enables the slider 6 be lifted and lowered in the vertical direction by the length of each guide portion 6*a*.

The actuator bracket 45 is a plate member forming the body of the position holder 4. The actuator bracket 45 is a metallic bracket supporting the slider 6 and the actuator holding portion 7 pinching a cylinder portion 5*a* of the actuator 5 such that the slider 6 and the actuator holding portion 7 can be vertically moved by a predetermined distance L5. The actuator bracket 45 is fixed to the base plate 2 by fixing pins 45*a* (see FIG. 3) and the coupling pins 30*a*.

<Striker Releaser>

The striker releaser 48 illustrated in FIG. 1 is an open lever that releases the latched state of the striker 12 latched by the latch 38*a* of the latch mechanism 38 provided to the latch body 3. The striker releaser 48 has one of the coupling pins 30*a*, the biasing spring 48*a*, a release portion 48*b* (see FIG. 4), and a cable coupling portion 48*c*. The striker releaser 48 and the biasing spring 48*a*, which biases the striker releaser 48, are pivotally supported coaxially with each other by the one coupling pin 30*a* pivotally supporting the first link 31 of the corresponding link mechanism 30 on the position holder 4.

A cable coupled to the cable coupling portion 48*c* is coupled to the hood open lever (not illustrated) disposed inside the cabin. When the hood open lever is operated, the cable coupling portion 48*c* is pulled and the striker releaser 48 is operated correspondingly.

As illustrated in FIG. 4, as the striker releaser 48 pivots about the coupling pin 30*a* in response to the operation of the hood open lever (not illustrated), the release portion 48*b* presses the latch release portion 38*e*, thereby causing the latch 38*a* to pivot in the direction of releasing the striker 12.

<Actuator>

The actuator 5 is a lifting driving device that is disposed to lie from the latch body 3 to the position holder 4 and lifts up the latch body 3 at a time of pop-up. Also, by extending, the actuator 5 lowers the actuator holding portion 7 and the slider 6 against the spring force of the spring member SP1 and indirectly pushes the latching portion 40 by means of the latching portion actuation pin 61 of the slider 6 to thereby release the latching state of the latching portion 40 latching the engagement portion 3*a*. In an example, the actuator 5 includes the cylinder portion 5*a* housing a gas generating agent that generates a high-pressure gas by being combusted and an ignition device for the gas generating agent, and the piston rod portion 5*b*, which is caused to project upward by a predetermined stroke from inside the cylinder portion 5*a* by the high-pressure gas.

<Slider>

As illustrated in FIG. 1, the slider 6 is a plate member disposed such that it can be moved vertically by the predetermined distance L5 relative to the position holder 4. The latching portion actuation pin 61 is provided to protrude from a lower end portion of the slider 6.

<Latching Portion Actuation Pin>

As illustrated in FIGS. 4 and 5, the latching portion actuation pin 61 is a latching portion actuation member that, when the slider 6 lowers, lowers along with it to swing the latching portion 40. The latching portion actuation pin 61 is disposed vertically movably inside the loose pin insertion holes 41*b* and 43*a* in the first and third latching portions 41 and 43. During a normal time, the slider 6 (see FIG. 1) is at a lifted position, and therefore the latching portion actuation pin 61 is disposed at the upper ends of the loose pin insertion holes 41*b* and 43*a*, maintaining the hooks 41*a* and 42*a* in a state of clutching the engagement portion 3*a*, as illustrated in FIG. 4. At a time of pop-up, the slider 6 is lowered by the actuator 5, thereby pivoting the latching portion 40 about the pivot pin 40*a* in the direction of releasing the hooks 41*a* and 42*a*, as illustrated in FIGS. 6 and 7. At this moment, the pivoted first latching portion 41 cuts the latching portion restriction member 40*c*.

<<Operation of Vehicle Latch Device>>

Next, operation of the vehicle latch device 1 according to the embodiment of the present invention will be described with reference to FIGS. 1 to 11B.

As illustrated in FIG. 1, during a normal time, the vehicle latch device 1 is in a state of being fixed at a lowered position by the latching portion 40. Thus, the latch body 3 coupled to an upper end portion of the piston rod portion 5*b* via the rod support member 35 and the rod support member coupling plate 37 is in its lowered state in a normal time relative to the base plate 2. The hood 11 is in a lowered positional state, maintaining the state of closing the opening portion of the engine compartment.

Also, the slider 6, the actuator holding portion 7, and the position holder 4 coupled to the cylinder portion 5*a* of the actuator 5 have been put in lifted positional states by the spring member SP1. As illustrated in FIG. 4, the latching portion actuation pin 61 of the lifted slider 6 is present at upper portions of the loose pin insertion holes 41*b* and 43*a*, causing the first latching portion 41 and the second latching portion 42 to clutch the engagement portion 3*a* provided integrally with the latch body 3, so that the latch body 3 maintains the lowered state.

Thus, as illustrated in FIG. 2, each link mechanism 30 is such that a distance L3 between the coupling pin 30*a* coupling the first link 31 and the position holder 4 and the coupling pin 30*c* coupling the second link 32 and the latch body 3 is shortest. During a normal time, a distance L2 between an upper end portion of the latch body 3 and a lower end portion of the position holder 4 is short as well, so that the latch body 3 and the position holder 4 are disposed close to each other. Thus, a vertical length L1 of the whole vehicle latch device 1 is short. This enables the device to be compact.

Then, when the ignition switch (not illustrated) is turned on, the collision detection device (not illustrated) is activated and turns to a state where it can detect a collision of a pedestrian with the vehicle. As a result, the vehicle latch device 1 turns to a state where it can start operating. If detecting a collision of a pedestrian with the vehicle, the collision detection device (not illustrated) transmits an actuation signal to the actuator 5 to actuate it.

The actuator 5 in turn ignites the gas generating agent inside the cylinder portion 5*a* illustrated in FIG. 1, so that a high-pressure gas is generated by the combustion of the gas generating agent. With the reaction force generated at the time of the ignition, the actuator 5 pushes the slider 6 and the actuator holding portion 7 in a downward (arrow a) direction by the distance L5, which substantially corresponds to the length of an elongated hole (guide portion 6*a*), against the spring force of the spring member SP1.

As illustrated in FIG. 6, by pressing and sliding on inner surfaces of the tilted loose pin insertion holes 41*b* and 43*a*, the latching portion actuation pin 61 provided on the slider 6 illustrated in FIG. 1 moves in the downward (arrow a) direction to the lower ends of the loose pin insertion holes 41*b* and 43*a* while pivoting the first latching portion 41 and the second and third latching portions 42 and 43 about the pivot pin 40*a*. As a result, the latching portion 40 pivoted by the latching portion actuation pin 61 turns to a state where the hooks 41*a* and 42*a* are spread, as illustrated in FIG. 7.

Since the hooks 41*a* and 42*a* are spread in an outward (arrow e) direction, the engagement portion 3*a*, which has been clutched vertically immovably by the hooks 41*a* and 42*a*, is instantly released with a smaller amount of movement, as illustrated in FIGS. 7 and 8. Thus, the responsiveness of the vehicle latch device 1 in releasing the position holding state is high.

As the latch body 3 is instantly pushed up by the high-pressure gas via the piston rod portion 5*b* and the like, the engagement portion 3*a* provided integrally with the latch body 3 exits the space between the hooks 41*a* and 42*a* and moves in an upward (arrows b and c) direction inside the guide portion 2*f* along with the slide pin 33*b*. As a result, pop-up to lift up the hood 11 (see FIG. 1) starts.

As illustrated in FIGS. 7 and 8, the latch body 3 is lifted up (arrow h) as two members of the engagement portion 3*a* and the slide pin 33*b*, which move together, are guided by the guide portion 2*f* provided to extend vertically in the center of the vehicle latch device 1. Accordingly, the latch body 3 stably moves straight in the upward (arrows b, c and h) direction.

Further, since left and right lower end portions of the latch body 3 and left and right upper end portions of the position holder 4 are coupled by the six-jointed link mechanisms 30 such that the latch body 3 and the position holder 4 can be lifted and lowered, the hood 11 can be lifted up in a horizontal posture when pushed up by the actuator 5. FIGS. 7-9 show the extension of the link mechanisms 30 (arrow g). As illustrated in FIG. 10, the link mechanisms 30 extend to a length L30 and thereby springs the latch body 3 upward by a distance L6 corresponding to the stroke of the link mechanisms 30. Thus, the vehicle latch device 1 can instantly lift up the hood 11. FIG. 10 illustrates a distance L40 between the base plate 2 and the hood 11 when the hood 11 is lifted. The link mechanisms 30 having extended upward have a rectangular shape and are therefore not easily deformed and have high stiffness in the vertical and lateral directions. This enables the link mechanisms 30 to firmly support the hood 11.

Figure 11A:
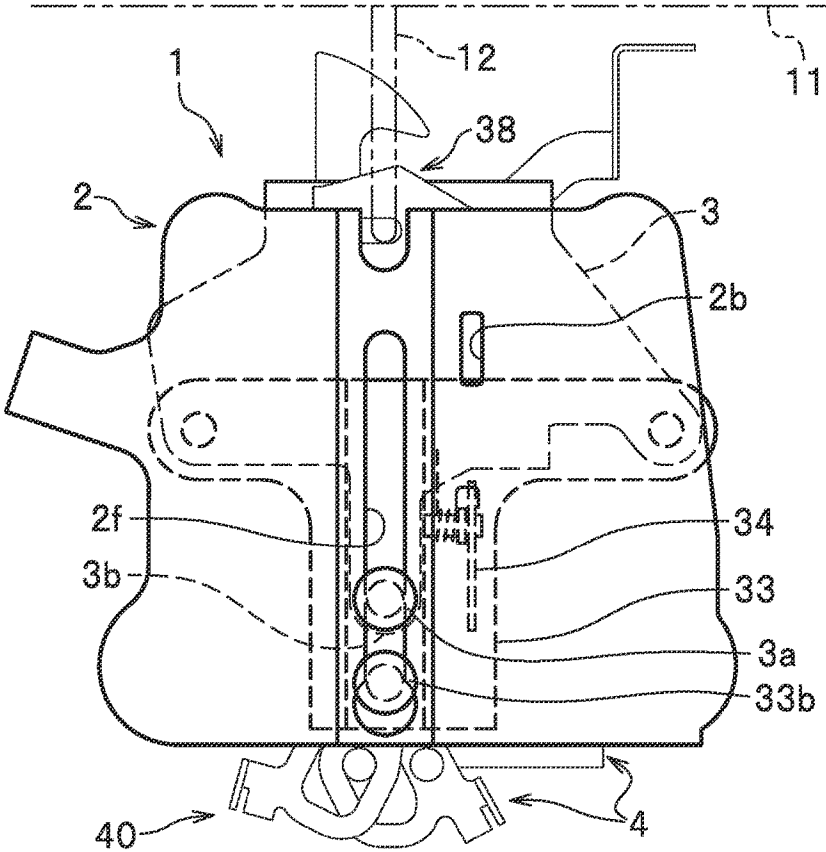
FIG. 11A is a schematic view illustrating the state of the vehicle latch device during a normal time.

As illustrated in FIGS. 11A and 11B, in the pop-up state reached by lifting up the hood 11 with the vehicle latch device 1, the latching hole 2*b* latches the locking portion 34*d* of the locking member 34 disposed on the slide member 33 provided integrally with the latch body 3, so that the hood 11 is held at the lifted position. This completes the pop-up operation of the vehicle latch device 1.

At the same time as the actuation of the vehicle latch device 1, the pop-up apparatus 100 actuates the hinge device (not illustrated) disposed on each of the rear left and right sides of the hood 11 to lift up the whole hood 11.

When a pedestrian collides with the vehicle, the vehicle latch device 1 elastically receives the pedestrian on the hood 11 lifted up by the actuator 5 via the latch body 3 and can therefore efficiently absorb the impact. The pop-up apparatus 100 maintains the hood 11 in the lifted state and can therefore prevent the hood 11 from lowering and contacting the power unit.

As described above, as illustrated in FIGS. 1 and 4, the present invention is a vehicle latch device 1 including: a latch body 3 capable of being lifted up in a state of latching a striker 12 provided to a hood 11 of a vehicle; a position holder 4 that holds a position of the latch body 3 on a vehicle body side during a normal time; and an actuator 5 that is interposed between the latch body 3 and the position holder 4 and lifts up the latch body 3 at a time of pop-up. The vehicle latch device 1 is preferably such that, on the position holder 4, a striker releaser 48 is disposed which releases a latched state of the striker 12 latched by a latch 38*a* of a latch mechanism 38 provided to the latch body 3.

In this way, in the vehicle latch device 1, the striker releaser 48, which releases the striker 12 latched by the latch 38*a*, is disposed on the position holder 4 and is therefore a separate member from the latch body 3. The latch body 3 and the hood 11 can thus avoid being affected by movement of the striker releaser 48. This makes it possible to more smoothly move the latch body 3 and the hood 11.

Also, the vehicle latch device 1 is preferably such that, as illustrated in FIG. 1 or 4, it further includes a link mechanism 30 that couples the latch body 3 and the position holder 4 to each other, and the striker releaser 48 is pivotally supported coaxially with a link (first link 31) of the link mechanism 30.

Thus, by pivotally supporting the striker releaser 48 coaxially with the first link 31 of the link mechanism 30, the number of shaft members is reduced. This makes it possible reduce the number of components and the number of man-hours for assembly and thus lower the cost. Moreover, since the striker releaser 48 can be disposed on the position holder 4, which holds the position of the latch body 3 on the vehicle body side, the striker releaser 48 can be fixed firmly.

MODIFICATIONS

Note that the present invention is not limited to the foregoing embodiment. Various modifications and changes can be made within the scope of the technical idea of the present invention, and the present invention covers inventions obtained through these modifications and changes, as a matter of course.

For example, only one vehicle latch device 1 may be provided at one position under a front center portion of the hood 11.

The actuator 5 only needs to be at least a device capable of lifting the latch body 3, and its structure is not particularly limited. The actuator 5 may be, for example, an electric motor gear device using an electric motor, a device utilizing the spring force from a spring, a device that projects a plunger with compressed air from a compressor, or a device that vertically moves a plunger (piston rod) with a piston cylinder device or the like.

Also, the collision detection device may be a collision prediction device that predicts a collision of a pedestrian with the vehicle by obtaining data for detecting the presence of the pedestrian, the distance to the pedestrian from the front part of the vehicle, the speed of the pedestrian, the difference between the speed of the vehicle and the speed of the pedestrian (relative speed), and the like.

This collision prediction device may operate to so as to determine animals, foreign objects other than animals, and so on as protection targets from an image obtained by a camera. Alternatively, the collision prediction device may determine only humans as protection targets or include two-wheeled vehicles such as bicycles as protection targets.

Further, under the hood 11, an airbag device may be provided which, at the time of a collision, expands an airbag over the hood 11 lifted up by the vehicle latch device 1 from the gap between the hood 11 and the vehicle body to protect the pedestrian colliding with the vehicle.

Also, for the coupling of the latch body 3 to the position holder 4 using the link mechanisms 30, the latch body 3 may be coupled to the base plate 2.

What is claimed is:

1. A vehicle latch device comprising:

a latch body capable of being lifted up in a state of latching a striker provided to a hood of a vehicle at the time of a collision;

a position holder that holds a position of the latch body on a vehicle body during a normal operation;

an actuator that is interposed between the latch body and the position holder and lifts up the latch body at a time of pop-up at the time of the collision; and a link mechanism that couples the latch body and the position holder to each other, wherein on the position holder, a striker releaser is disposed which releases a latched state of the striker latched by a latch of a latch mechanism provided to the latch body, and the striker releaser is pivotally supported coaxially with a link of the link mechanism.

* * * * *